United States Patent [19]

Turnbull et al.

[11] 4,356,835

[45] Nov. 2, 1982

[54] HYDRAULIC CONTROL VALVE FOR SELECTIVELY SUPPLYING FLUID TO HYDRAULIC SERVICES

[75] Inventors: William S. Turnbull, Wolverhampton; Gary W. Pugh, Dunston, both of England

[73] Assignee: Kontak Manufacturing Company Limited, Grantham, England

[21] Appl. No.: 139,295

[22] Filed: Apr. 11, 1980

[30] Foreign Application Priority Data

Apr. 12, 1979 [GB] United Kingdom ..... 7912914

[51] Int. Cl.[3] ..... F15B 18/00

[52] U.S. Cl. ..... 137/117; 91/530; 91/532; 137/596.13

[58] Field of Search ..... 91/513, 530, 531, 532; 137/117, 596.13

[56] References Cited

U.S. PATENT DOCUMENTS

| | | | |
|---|---|---|---|
| 2,869,567 | 1/1959 | Carlson | 137/117 |
| 2,988,891 | 6/1961 | Hemings | 91/530 X |
| 3,077,901 | 2/1963 | Klessig | 91/532 X |
| 3,162,095 | 12/1964 | Koons | 91/530 |
| 3,324,881 | 6/1967 | Keir | 137/596.13 |
| 3,998,134 | 12/1976 | Budzich | 137/117 X |

*Primary Examiner*—Robert G. Nilson

*Attorney, Agent, or Firm*—Scrivener, Clarke, Scrivener and Johnson

[57] ABSTRACT

A hydraulic control valve provides controlled fluid supply for two hydraulic services having different flow and pressure requirements, as for example a lift service of a lift truck for lifting loads vertically and a tilting service for tilting loads forwardly and rearwardly. Two landed spools operate in parallel adjacent bores each joining a plurality of chambers and connected to fluid pressure supply and tank service ports. The supply to port communicating with one of the bores through two of the chambers, so that flow area is increased and the pressure drop of fluid flowing through them is reduced, and is connected through the bore and chambers to the tank port when the respective spool is in a neutral position and selectively to the service ports by movement of the spool. A pressure responsive valve communicates with one supply passage and tank passage and spills fluid from the supply passage to the tank passage in response to a predetermined pressure drop across a restrictor in a fluid supply passage downstream of one of the bores. Preferably the valve includes a piston spring biased and urged by fluid pressure downstream of the restrictor to a valve closed position and having as large an effective area as practicable so that a low pressure differential operates the valve, thereby minimizing power loss through the restrictor.

4 Claims, 6 Drawing Figures

HYDRAULIC CONTROL VALVE FOR SELECTIVELY SUPPLYING FLUID TO HYDRAULIC SERVICES

Figure 1:
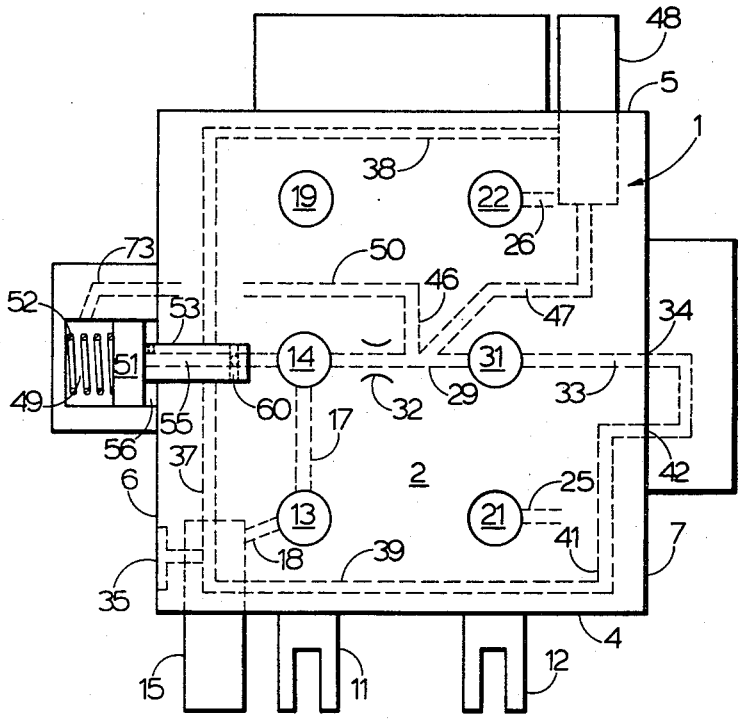

This invention relates to hydraulic control valves, particularly, though not exclusively for use on industrial lift trucks.

Industrial lift trucks are characterised by having at least two hydraulically operated services which have very different requirements. The lift service for lifting loads requires a high flow rate at high pressure for high lifting speeds, whilst the tilt service requires a low flow rate at a reduced pressure for sensitive control to facilitate safe operation near limits of stability. Generally, for cost reasons, a single pump is used to supply fluid to both services. A compromise solution which has been used is to fit tilt jacks which are considerably larger than necessary so as to absorb a greater proportion of the pump output and so facilitate control of the tilt service. This involves penalties due to increased cost and weight and increased space requirements. An alternative approach is to fit the correct size tilt jacks for the service requirement and to restrict the flow to these jacks. The flow restriction causes lifting of the relief valve, waste of energy and excessive heating of the hydraulic fluid. Frequently a compromise between these two is used, using oversize tilt jacks and flow restriction.

The present invention provides an hydraulic control valve which will assist in resolving the aforesaid difficulties and seeks to reduce losses and thereby improve power economy and reduce undesirable heating of the hydraulic fluid.

The type of hydraulic control valve with which the invention is particularly concerned has first and second spaced bores extending between a pair or pairs of opposed faces in a valve body, and a plurality of chambers associated with and spaced longitudinally of each bore and communicating therewith. In each bore there is a landed valve spool slidable therein so as selectively to connect adjacent chambers along that bore. A fluid pressure supply port and a tank port are connected through said chambers in the body by fluid supply and tank passages when the valve spools are in a neutral position, and service ports in the body are selectively connectable to the fluid pressure supply and to the tank by way of the respective passages and chambers by movement of the valve spools. Such a valve is hereinafter referred to as "of the type described".

The present invention consists in a valve of the type described in which a fluid pressure supply port in one face of the body communicates with the first bore. There is a tank port in a face of the body and a tank passage or passages in the body connect chambers adjacent at least one end of each bore to the tank port. Fluid pressure responsive valve means is mounted in or on the body and is in communication with a supply passage and a tank passage, restrictor means being provided in a fluid supply passage downstream of the first bore. Means connects the fluid on either side of the restrictor means across a pressure responsive member of the valve means whereby a predetermined pressure drop across the restrictor means causes operation of the valve means to spill a portion of the fluid in the supply passage to the tank port.

The supply port may be connected to the tank port when the valve spools are in a neutral position via the, or one of the, said tank passages.

The supply port may be in one of an upper or lower face of the body and near to one end of the first bore.

The supply port may communicate with the first bore via two chambers spaced longitudinally of the bore so as to increase the flow area and thereby reduce pressure losses when the first spool is in the neutral position. A check valve may control admission to one of these chambers.

The tank port may be in a side face of the body and adjacent to the supply port.

A first pressure relief valve may be fitted to the body adjacent the supply and tank ports and in communication with a fluid supply passage and a tank passage adjacent the respective ports to connect them when a predetermined fluid pressure at the supply port is exceeded.

A second pressure relief valve may be fitted to the body in communication with a fluid supply passage downstream of the restrictor means and with a tank passage to connect them when a predetermined pressure in that fluid supply passage is exceeded. The second pressure relief valve may be set to relieve at a lower pressure than the first pressure relief valve.

The fluid supply and tank passages connecting the supply and tank ports when the valve spools are in a neutral position may include ports in a face of the body, one in communication with a supply passage and the other with a tank passage, and a fluid-tight cover fitted to the face spanning the said ports and allowing communication between them.

The arrangement of this face and the ports may be such as to enable one or more additional valve bodies, each containing a valve spool for controlling a further hydraulic service, to be added between the face and the cover.

The fluid pressure responsive valve may include a piston slidable in a cylinder and biassed by spring means and fluid pressure downstream of the restrictor means in a direction to close the valve. Means may be provided to adjust the spring loading whereby the operation of the pressure responsive valve is modified.

Figure 2:
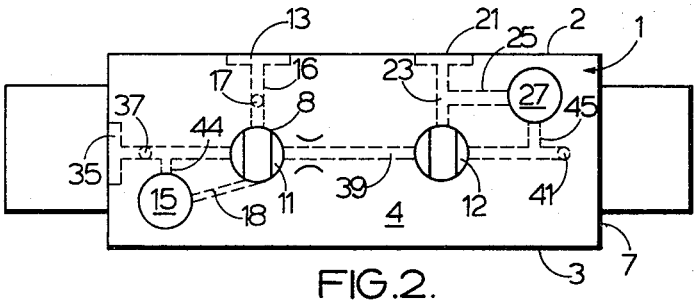
Figure 3:
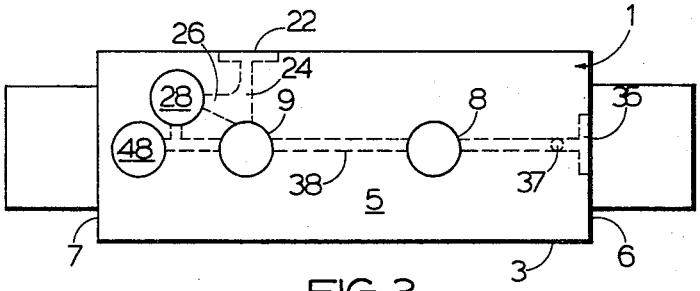
Figure 4:
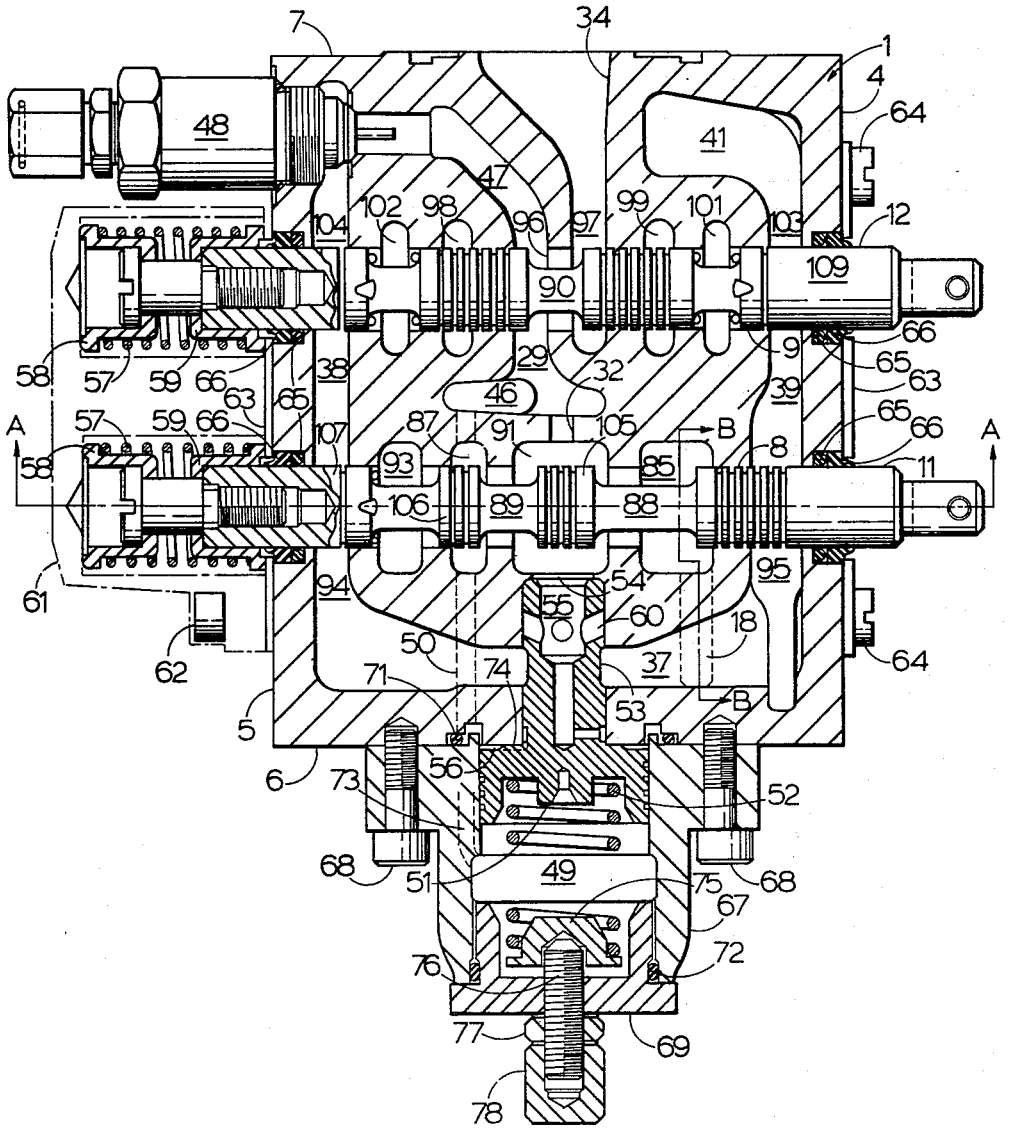
Figure 5:
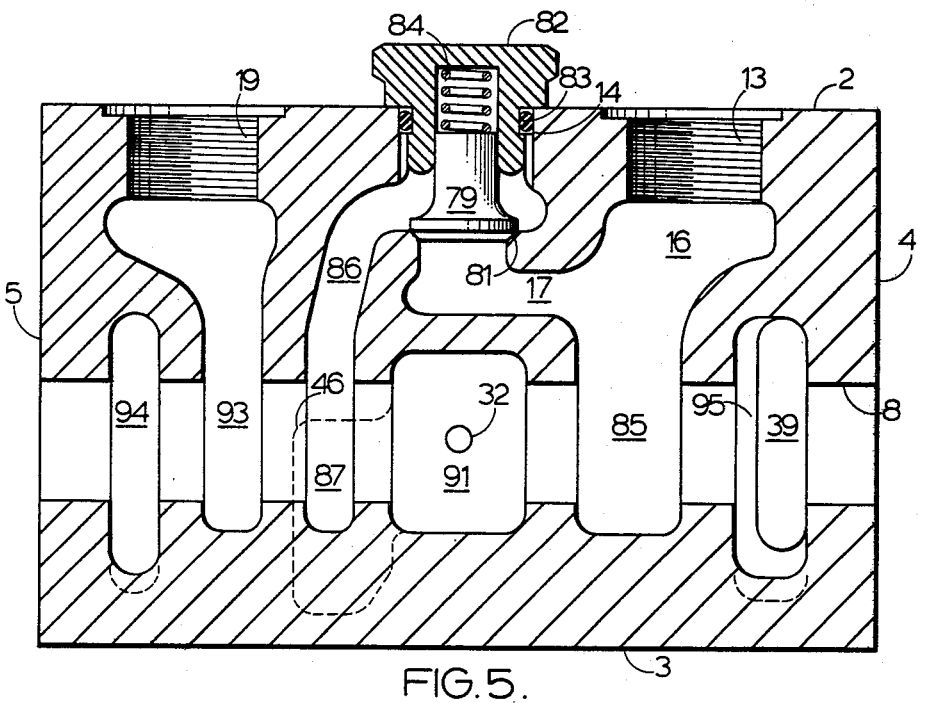
Figure 6:
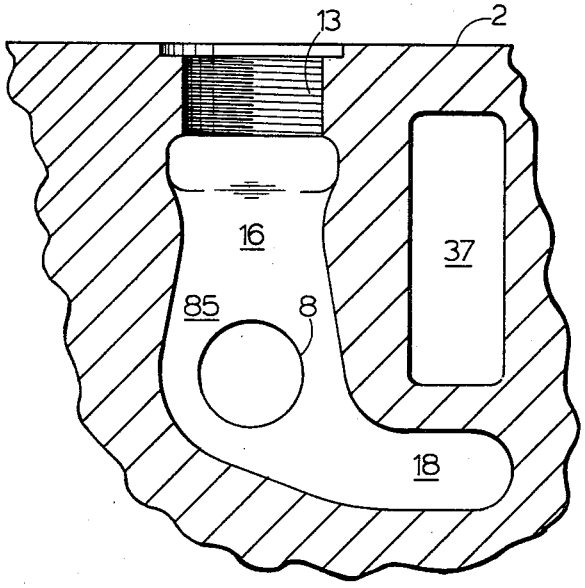

An embodiment of the invention will now be described, by way of example, with reference to the accompanying drawings in which:

FIG. 1 is a view looking on the top of a hydraulic control valve which is represented diagrammatically, FIGS. 2 and 3 are views on two opposed faces of the valve of FIG. 1, FIG. 4 is a cross-section through a hydraulic control valve, FIG. 5 is a section on line 5—5 of the valve body of FIG. 4, and FIG. 6 is a section on line 6—6 of the valve body of FIG. 4.

Referring to FIGS. 1 to 3, a valve body 1 has an upper face 2, a lower face 3 and opposed pairs of side faces 4,5 and 6,7. Spaced parallel bores 8,9 between side faces 4,5 slidably receive valve spools 11,12. The spools may have the usual metering slots at the land edges.

A fluid pressure supply port 13 communicates with the bore 8, a port 14 and a relief valve 15 by way of respective passages 16,17,18. A check valve is housed in the port 14 (shown in FIG. 5). A service port 19 communicates with bore 8 (shown in FIG. 5) and is for connection to a single acting service such as the lift jack of an industrial lift truck. Ports 21,22 (for example for connection to a double acting service such as mast tilt jacks on a lift truck) communicate with the bore 9 through passages 23,24 respectively. Passages 25,26 connect these ports with ports 27,28 respectively in which service line relief valves (not shown) may be fitted.

Passage 16 leads by way of bore 8 to a restrictor 32, passage 29, the bore 9 and a further passage 33 to a port 34 in face 7 of the body. Passage 29 also leads to the upstream side of a check valve in a port 31.

A tank port 35 in face 6 of the body is connected to interconnected tank passages 37,38,39,41 which follow the side walls of the body 1. Passage 41 connects with a port 42 in face 7 and a cap 43 secured to the face connects ports 34,42. Passages 38,39 connect with chambers at each end of the bore 8,9. Passage 39 connects with the downstream side of the relief valve 15 by way of a passage 44 and with the downstream side of the service line relief valve in port 27 by a passage 45.

Passage 29, which is downstream of the restrictor 32, is connected by a passage 47 to a relief valve 48 fitted in a port in face 5. The downstream side of the relief valve 48 connects with passage 38, as does the downstream side of the service line relief valve in port 28. The upstream side of the service line relief valve is connected to passage 47. A passage 73 connects passage 29 by passages 46,50 with a chamber 49 in which a piston 51 is slidable against the load of a spring 52. A valve 53, integral with piston 51, is slidable in a bore in the body 1. The upstream side of valve 53 is connected to bore 8 by way of a passage 54. The valve has a through passage 55 leading to a chamber 56 on the opposite side of the piston 51 from chamber 49. Valve 53 also has a port 60 which, when the piston and valve move to compress the spring 52, interconnect passage 54 and 37.

Referring now to FIG. 4, which is a horizontal cross-section through a valve on a plane corresponding to a horizontal plane passing through the centre of the bores on the diagrammatic representation shown in FIGS. 2 and 3, the relief valve 15 being omitted, parts corresponding to those in the embodiment of FIGS. 1 to 3 have the same reference numerals.

The valve spools 11,12 are biassed to a neutral position in known manner by centering springs 57 acting between cupped washers 58,59 slidably mounted on the ends of the valve spools which extend from face 5 of the body. The spool ends are enclosed in a cap 61 secured by screws 62. The cap provides a stop for the washers 58.

Seal plates 63, secured by screws 64, retain seals 65 and wiper rings 66. The usual operating levers of known type for the spools have been omitted. Relief valves 15,48 are of the pilot-operated type of known construction. Similarly, service line relief valves are of known construction.

The pressure responsive valve includes a housing 67 secured to the face 6 of the body 1 by screws 68 and an end cap 69, which is screwed into the outer end of the housing. Fluid pressure seals are provided at 71,72. Passage 50 registers with a passage 73 in the housing which opens into chamber 49, an O ring seal (not shown) being provided at the joint between face 6 and the housing. Passage 55 connects with chamber 56 through slots 74 in the face of the piston 51. A spring seat 75 is adjustably positioned in chamber 49 by a screw 76 engaged with and passing through the end cap 69. The adjustment is locked by a nut 77 on the screw 76 and a cap nut 78 is fitted to the end of the screw. Sealing washers are provided between the cap 69 and the nut 77 and between the latter and the cap nut 78.

Referring to FIG. 5, the check valve in port 14 comprises a valve member 79 which engages a seating 81, a cap 82 which is screwed into the port 14, a sealing ring 83 and a spring 84. Fluid entering port 13 can flow through passage 16 to a chamber 85 and through passage 17, past the check valve 79 to a passage 86 and a chamber 87. Bore 8 passes through chambers 85,87. When the spool 11 is in its neutral position, as shown in FIG. 4, the fluid can flow past reduced diameter portions 88,89 of the spool 11 to a chamber 91 and thence through the restrictor 32 and port 46 to passages 50 and 73. The fluid can also flow to passage 54. The port 46, shown in dotted outline in FIG. 5 and in full lines in FIG. 4, corresponds to passage 46 of FIG. 1. A chamber 93 is connected to port 19 and chambers 94,95 connect with tank passages 38,39 respectively, bore 8 passing through the chambers 93,94 95.

Referring now to FIG. 6, this shows the connection of port 13 by way of the passage 16 and chamber 85 to passage 18. The high pressure or upstream side of the relief valve 15 communicates with passage 18 and its low pressure or downstream side communicates with tank passage 37.

Referring again to FIG. 4, passages 29,47 are connected by a chamber 96 which also connects with the upstream side of a check valve in port 31 (FIG. 1) which is similar to the check valve in port 14 (FIG. 5). When the spool 12 is in the neutral position, as shown, a reduced diameter portion 90 of the spool 12 connects chamber 96 to a chamber 97 which is connected to port 34 by passage 33.

The downstream side of the check valve in port 31 is connected to chambers 98,99. Chambers 101,102 are connected to ports 21,22 (FIG. 1) respectively, and further chambers 103,104 are connected with tank passages 38,39 respectively. Bore 9 passes through the chambers 103,101,99,97,96,98,102, and 104.

The operation of the valve will now be described.

1. Spools in neutral.

Pressure fluid supplied at port 13 passes through passage 16 to chamber 85, whence it passes along bore 8 to chamber 91. It also passes along passage 17, past check valve 70, through passage 86 and chamber 87 and along bore 8 to chamber 91. The pressure in chamber 91 is applied by way of passage 54 to the end of valve 53 and to the piston 51 in chamber 56. Flow passes through restrictor 32 to passage 29, chamber 96, along bore 9 to chamber 97, passage 33 and port 34. The pressure in passage 29 is communicated through passages 46,50,73 to chamber 49 where it acts on piston 51, together with spring 52 in opposition to the higher pressure from upstream of the restrictor 32 in chamber 56. Depending on the spring load and the area and pressure ratios either side of the piston it will move together with valve 53 compressing spring 52 and opening ports 60 to tank passage 37, and tank port 35 whereby a portion of the fluid supplied at port 13 is spilled to tank without passing through restrictor 32 and bore 9. The flow passing to port 34 (as described with reference to FIGS. 1 to 3) enters cap 43 which connects it to port 42 whence it passes through tank passages 41,39 and 37 to tank port 35. Tank port 35 lies above the plane of FIG. 4 and is consequently not shown.

2. Lift spool selected.

When spool 11 is moved from neutral to the right (as viewed in FIG. 4) lands 105,106 of the spool first restrict and then stop the flow through bore 9 from chambers 85,87 to chamber 91.

At the same time, the land 106 opens communication between chambers 87 and 93 whereby all the flow passes through the port 19 to the lift jack.

When spool 11 is moved from neutral to the left, a land 107 opens communication between chambers 93,94 whereby the lift jack is connected to tank by passages 38,37 and tank port 35. At the same time the fluid supplied at port 13 follows the same paths as have been described when the spools are in neutral.

If the pressure at port 13 attains the relief pressure of the valve 15, then flow will pass through passage 18 and relief valve 15 to tank port 35 through passage 37.

3. Tilt spool selected.

When spool 12 is moved to the right, a land 108 first restricts and then stops flow between chambers 96,97 and flow from passage 29 passes through the check valve in port 31 (FIG. 1) to chambers 98,99. Movement of land 108 opens communication between chambers 98,102 so that flow passes to the tilt jacks (or other double acting service) through port 22. The consequential flow from the tilt jacks entering port 21 passes to chamber 101 which has been opened to chamber 103 by movement of a further land 109. Flow then passes through passages 39,37 to tank port 35. Similarly when spool 12 is moved to the left, it is chamber 101 which receives pressure fluid and chamber 102 which is connected to tank.

If the pressure in passage 29 attains the relief pressure of relief valve 48, then flow from passage 29 passes to tank through the passage 47, relief valve 48, tank passages 38,37 and tank port 35. It will be noted that this flow is less than that which has entered port 13 as part of the flow has been diverted to tank by valve 53. The relief pressure setting for valve 48 will normally be less than that of the main relief valve 15, contributing to a saving in energy and reduced heating of the fluid.

If the pressure in either of chambers 101 and 102 increases to the relief value of the service line relief valves in ports 27,28 respectively, if fitted, then flow occurs through whichever valve lifts and passes to the tank port 35.

The check valves in ports 14,31 support the loads in services when selected.

In the design of the pressure responsive valve, it is desirable that the piston area should be as large as practicable so that a low pressure differential is sufficient to operate the valve, so minimising the power lost through the restrictor 32. The valve 53 should be of a size to pass the desired spill flow with a minimum pressure drop. This can be achieved with a large diameter short travel valve or a smaller diameter longer travel valve. A relatively short travel valve is desirable, but consistent with stable operation, so as to reduce the load variation of the spring 52. Generally a valve diameter of the same order as that of the first spool will be satisfactory. A spring with a flat rate characteristic is desirable.

The ports 60 in valve 53 may be varied in number, (four are shown in FIG. 4) orientation and shape, and are desirably arranged so as to minimise the component of the flow reaction force which acts in a direction to move the valve 53.

In the embodiment described the valve 53 crosses the tank passage 37 adjacent the tank port 35. This is a preferred configuration for minimising the length of the flow path for the spilled flow. As described, the housing 67 for the pressure responsive valve is separate from the body 1 but could be made integral with the body.

The diameter of the piston is desirably at least 1.3 times the diameter of the valve. The upper limit for the size of the piston will be determined largely by space and dynamic response considerations and suitable values are chosen to meet the desired pressure drop requirements through the control valve. As a guide, a suitable ratio of piston area to valve area lies in the range from 3:1 to 5:1. In the example described, the ratio is approximately 4:1, that is, the piston diameter is twice that of the valve.

In one example of the valve in practice, the ports 60 are of 6 mm diameter drilled at an angle of 70° to the axis of the valve 53. With the restrictor 32 of 5.8,7.1, and 9.1 mm diameter the control valve is designed to pass flows of 18,27 and 45 liters/minute respectively to the second spool. Thus, by variation of the orifice size (in manufacture or in service, e.g. by screwed fitting of jets of different sizes) and adjustment of the compression of the spring 52 to vary the initial spring load by the adjusting screw 76 the operating characteristics of the valve 53 can be varied. This facility is of particular value in enabling the same hydraulic control valve to meet varying specifications of different requirements of the valve in use.

In the embodiment described, tapped holes may be provided in the lower surface 3 of the body 1 adjacent the corners, or some of them, for mounting of the control valve.

We claim:

1. A hydraulic control valve comprising: a body having a plurality of faces including at least one pair of opposed faces and adjacent first and second bores extending between said opposed faces; each of said bores having a plurality of chambers spaced longitudinally thereof and communicating therewith; a landed valve spool in each of said bores slidable between a neutral position and at least one effective position in which selected communication is provided between adjacent chambers along said bore; a fluid pressure supply port in one of said faces which communicates with said first bore by way of first and second of said chambers spaced longitudinally of said first bore, whereby the increased flow area provided by said two chambers reduces the pressure drop occassioned by flow through them; a check valve disposed between said supply port and one of said two chambers adapted to control admission of pressure fluid from said supply port to that said one chamber and to prevent reverse flow from that said one chamber to said supply port; a tank port in one of said faces; tank passages connecting certain of said chambers to said tank port; fluid supply passages connecting said supply port, said first and second chambers, a third one of said chambers connected to said first bore and also having connection with said second bore and arranged that when said valve spools are in their neutral positions said supply port is connected to said tank port through said fluid supply passages said first, second and third chambers, and said tank passages; service ports connected to others of said chambers and connectable to said fluid supply and tank passages when said valve spools are in said effective positions, said valve spool in said first bore when in said effective position selectively connecting that one of the first and second chambers between which and said supply port said check valve is disposed with one of said service ports by way of said first bore; restrictor means in one said fluid supply passage downstream of said first bore, and valve means having a fluid pressure responsive member and being in communication with one said fluid supply passage and with one said tank passage and being constructed and arranged to respond to a pre-determined pressure drop across said restrictor means to cause a portion of fluid in said supply passage to spill to said tank port when said first spool is in said neutral position.

2. A hydraulic control valve as claimed in claim 1 in which: said body comprises a single casting containing said first and second bores; said fluid pressure responsive member comprises a piston having a smaller diameter portion and a larger diameter portion which provides a full area side of said piston and an annular area side of said piston; a housing which is detachably secured to one of said faces of said housing and has a bore in which said larger diameter portion of said piston is slidable; said body having a third bore extending through one of said faces of said body and communicating with said third chamber connected to said first bore, and in which said third bore said smaller diameter portion of said piston is slidable whereby an end of said smaller diameter portion is in communication with said third chamber connected to said first bore; passage means in said body, provide communication by way of said housing between the downstream side of said restrictor means and said full area side of said piston; spring means acts between said housing and said piston and biases said piston into said third bore, and passage means in said piston provide communication between said third chamber and said annular area side of said piston.

3. A hydraulic control valve as claimed in claim 1 in which: said valve member is a spool slidable by said piston to connect said supply and tank passages, and said piston has an effective diameter at least 1.3 times larger than the effective diameter of said spool.

4. A hydraulic control valve as claimed in claim 3 in which said piston has an effective area which is 3 to 5 times larger than the effective area of said spool.

* * * * *